US005169139A

United States Patent [19]

Stauber et al.

[11] Patent Number: 5,169,139

[45] Date of Patent: Dec. 8, 1992

[54] STABILIZATION AND POSITIONING OF PRINTED PRODUCTS DURING CONVEYING

[75] Inventors: Hans-Ulrich Stauber, Grüt; Urs Kaelin, Hinwil, both of Switzerland

[73] Assignee: Ferag AG, Hinwil, Switzerland

[21] Appl. No.: 754,036

[22] Filed: Sep. 3, 1991

[30] Foreign Application Priority Data

Oct. 19, 1990 [CH] Switzerland ..... 3350/90

[51] Int. Cl.[5] ..... B65H 29/04

[52] U.S. Cl. ..... 271/204; 271/315; 198/470.1

[58] Field of Search ..... 271/82, 85, 190, 204-206, 271/315; 198/470.1

[56] References Cited

U.S. PATENT DOCUMENTS

| | | | |
|---|---|---|---|
| 4,448,408 | 5/1984 | Faltin | 271/204 |
| 4,706,951 | 11/1987 | Leu | 271/204 |
| 4,743,005 | 5/1988 | Reist | 271/204 |
| 4,801,132 | 1/1989 | Reist | 271/204 |
| 4,871,159 | 10/1989 | Peterson | 271/204 |
| 4,921,294 | 5/1990 | Klopfenstein | 271/204 |

FOREIGN PATENT DOCUMENTS

| | | |
|---|---|---|
| 0305671 | 3/1989 | European Pat. Off. . |
| 2247408 | 5/1975 | France . |
| 2182025 | 5/1987 | United Kingdom . |

*Primary Examiner*—Robert P. Olszewski
*Assistant Examiner*—Steven M. Reiss
*Attorney, Agent, or Firm*—Walter C. Farley

[57] ABSTRACT

A method and apparatus are used for positioning and stabilizing flat articles at a specific point (P) of a conveying path, the articles being conveyed in a suspended manner. Non-rigid articles which are conveyed at such a speed that they are deflected by the air resistance from their vertical, flat position, are positioned so that they can be guided into a closely defined compartment of a processing drum with their lower edge at the front. For this purpose guide elements (12) are inserted from above into the conveying flow and over an insertion path (ES), gradually bring the printed products (11) into the intended position and over a following discharge path (AS) discharge the guide elements upwards again out of the conveying flow. The described embodiment of the apparatus comprises chains, closed to form a loop and positioned laterally of the conveying flow, which pass over sprockets and on which the guide elements (12) are arranged at regular intervals.

23 Claims, 4 Drawing Sheets

STABILIZATION AND POSITIONING OF PRINTED PRODUCTS DURING CONVEYING

FIELD OF THE INVENTION

The invention relates to a method and an apparatus for the locally precise guidance and stabilization of flat articles, particularly printed products, conveyed e.g. in a suspended or hanging manner.

BACKGROUND OF THE INVENTION

Flat articles, such as e.g. printed products, are conveyed suspended in a conveying or feed flow, in that a conveying means, e.g. clips or grippers engage on the upper edge of each printed product. From such a suspended conveying movement, by simply opening the conveying means the printed products are individually conveyed downwards by gravity to some other processing stage, while the conveying means continue to move on in a substantially linear manner. A use example of such a suspended supply to a processing stage is the supply to a processing drum in which e.g. preliminary products and/or inserts are inserted in printed products. A corresponding apparatus with a suspended feed is described in U.S. Pat. No. 4,801,132 (corresponding to Swiss patent 668 244) and the latter patent specification is assumed as known.

The advantage of a suspended or hanging supply or feed is that the conveying means do not have to be guided in the immediate vicinity of the feed. Thus, the actual feed is undisturbed and the conveying means can be led away in simple manner from the feed point. The suspended printed product is supplied with the lower edge leading. This means that the accuracy of the feed is dependent on the positioning accuracy of said lower edge. For sufficiently rigid, relatively slowly conveyed printed products such a feed constitutes no problem because the position of the lower edge is relatively accurately defined and is always positioned perpendicularly above the upper edge. Therefore feed can take place in a locally closely defined manner. As described in the aforementioned patent, it is also possible to engage the lower edges of the suspended printed products shortly upstream of the feed point with a conveyor belt running parallel to the conveying direction and in this way stabilize the same. If the speed of the conveyor belt is the same as the conveying speed, the printed products will reach the feed point in the vertical position. If the conveyor belt speed is not precisely the same as the speed of the conveying elements, then the lower edge of the printed products is accelerated or decelerated compared with the upper edge and at the feed point the printed products have a slightly inclined position, which can be advantageous for the supply, e.g. to a processing drum.

However, if the printed products conveyed in a suspended manner are not particularly rigid and also the conveying speed is so high that there is significant air resistance, the position of the lower edge of the printed products is not defined and consequently precise feeding with the lower edge to the front is problematical. Thus, if the feed or supply must be clearly defined in such a case, the spacings between the individual printed products in the feed flow must be very large and the feed point must be very wide. For a given production rate, this leads to higher conveying speeds and therefore to higher air resistances and is consequently inappropriate for achieving a precise speed. A guidance of the lower edge of the printed products with additional clips or grippers, which secure the lower edge of said products, is conceivable, but expensive from the apparatus standpoint, because the additional clips must continue over the entire feeding or conveying path, because as soon as the air resistance acts on the printed products, they can no longer engage on the latter due to the undefined position of the lower edges. It is also disadvantageous in the case of sensitive printed products to secure them with more clips than are absolutely necessary.

SUMMARY OF THE INVENTION

An object of the invention is to provide a method enabling flat articles and in particular printed products, which are held by individual conveying means, such as in a suspended manner on clips, to be conveyed, stabilized at specific points of the conveying path and precisely positioned. In particular the position of an edge not held by the conveying means, e.g. the lower edge of suspended printed products, must be precisely defined and stable at one point of the conveying path relative to the edge held by the conveying means, e.g. the upper edge of suspended printed products. The method must in particular be usable for flat, not very rigid articles, which are conveyed at high speed, so that, without stabilization by the air resistance, they can not only be moved from their conveying position, e.g. suspended position, but additionally also bent. The method is intended to protect sensitive printed products, in that it gradually brings them from the position deflected by the air resistance into the intended position. Another object of the invention is to provide an apparatus for performing the method, which is to be uncomplicated, simple and robust.

BRIEF DESCRIPTION OF THE DRAWINGS

The method and apparatus are described in greater detail hereinafter with reference to the drawings, wherein.

DESCRIPTION OF THE PREFERRED EMBODIMENTS

The basic principle of the inventive method is based on the fact that, upstream of a positioning location, at which the suspended printed products of a conveying flow are to have a specific position, guide means are introduced from above (i.e. from that side of the conveying flow at which the printed products are held by the conveying means) into the conveying flow, the guide elements are moved up to the positioning point in the conveying flow in such a way that they gradually move the printed products of said flow into the intended position and, following said positioning location, the guide elements are guided upwards again out of the conveying flow. With each printed product is associated a guide element. The guide elements move with a constant spacing from one another and at a constant speed on a closed path, part of the closed path running within the conveying flow.

Figure 1:
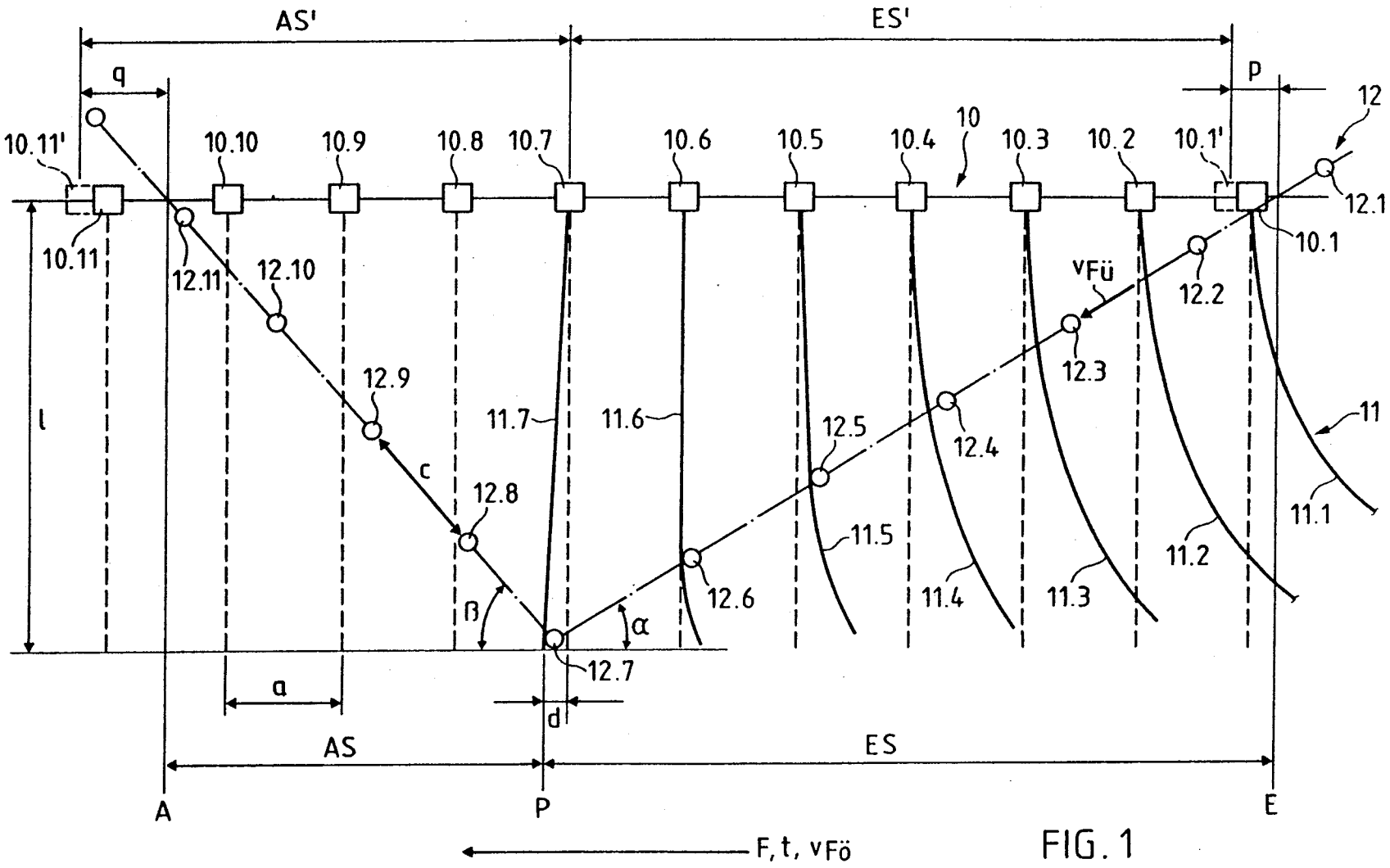
FIG. 1 is a schematic diagram of one embodiment of the sequence of the method in accordance with the invention.

FIG. 1 diagrammatically shows one embodiment of the inventive method. It shows a conveying flow of suspended printed products 11.1, 11.2, and 11.3 which are conveyed by conveying means 10.1, 10.2 and 10.3. These can e.g. be a driven chain with grippers. The conveying direction F is from right to left in the drawing and the suspended or hanging printed products have a spacing A from one another and the feed or conveying speed is $v_F$ö. The drawing can also be understood in such a way that a printed product 11x conveyed by a conveying means 10x is shown at different times which are separated by time intervals T, which are required in order for the printed product 11x to cover the distance a (time axis directed from right to left), so that $T=a/v_F$ö. The printed products 11 are shown by continuous lines in typical real positions caused by the air resistance and in broken line form in a vertical position which they would assume without any air resistance. The aim of the inventive method is to bring the printed products 11.1–11.3 at the positioning point P into an intended, precisely defined position, e.g. sloping to the vertical in such a way that the lower edge is positioned downstream of the upper edge in the conveying direction by a distance d; the position being that in which the printed product 11.7 is shown. This is achieved by providing over part of the conveying path, namely from the introduction point E in the conveying direction upstream of the positioning point P to the delivery or discharge point A following the positioning point P, guide elements 12.1, 12.2 and 12.3 are moved in the conveying flow. The guide element 12x is moved into the conveying flow at position E between the printed product 11x and the printed product 11x−1 and passes through the conveying path to the discharge point A between said two printed products. So that it does not come into conflict with the conveying means 10x at the insertion point E, on insertion it has a distance p from the printed product 11x, in which $p<a$, preferably $\leqq a/2$. So that it does not come into conflict with the conveying means 10x at the discharge point A, on discharge it has the spacing or distance q from the printed product 11x, in which $q<a$, preferably $\leqq a/2$. The minimum magnitudes of p and q are determined by the construction of the conveying means 10 and guide elements 12. For the representation of the distances p and q in the drawing, the conveying means 10.1 and 10.11 are shown in broken line form (10.1', 10.11') and also in the position which they assume at the time when the corresponding guide element 12.1 or 12.11 is introduced into or removed from the conveying flow.

Along an insertion path ES (between the insertion point E and the positioning point P) the guide element 12x moves downwards and concurrently moves in the conveying direction toward a position relative to the printed product 11x which corresponds to the intended position of said product 11x at the positioning point P. At the latter it reaches a position in which the conveying direction corresponds to the intended position of the printed product 11x and downwards it has a clearly defined position relative to the lower edge. As the guide element 12x approaches the printed product 11x in the conveying direction from the rear, i.e. against the air resistance, the printed product is driven by the air resistance against the guide element 12x. As soon as the latter is sufficiently far down and sufficiently near to the printed product 11x, so that the latter is pressed by the air resistance against the guide element 12x (in the drawing 10.5/12.5 and 10.6/12.6), active guidance and stabilization commence. The intended, bottom position of the guide elements 12 relative to the lower edge of the printed products 11 is dependent on the rigidity of the products 11 and the conveying speed, i.e. the air resistance. More rigid printed products 11 require less guidance, i.e. the guide element 12x does not have to be guided right up to the lower edge of the printed product 11x. For less rigid printed products 11 a guidance up to the lower edge is desired, but through appropriate design of the guide elements 12 it must be ensured that the printed products 11 are not pressed rearwards over the guide elements 12 by the air resistance. In the drawing the vertical distance l between the insertion point E and the bottom position of the guide element 12 (12.7) roughly corresponds to the length of the printed products 11.

In the time during which the guide element 12x moves along the insertion path ES, the printed product 11x is conveyed along a path ES', which is shorter than the path ES by the portions p and d. The same number of guide elements 12 and printed products 11 move on the insertion path ES. Thus, for the spacing c between the guide elements 12 and for the speed $V_F$ü of the guide elements 12, the following conditions apply:

$$(a \cdot ES)/(c \cdot ES') = \cos \alpha$$

in which $tg\alpha = l/ES$ and $ES' = ES - d - p$.

$V_F$ü:$V_F$ö = c:a.

Following the positioning point P, where for most applications the lower edge of the printed product 11x is taken over by another guide, such as the edges of the compartment of a processing drum in which the printed product is to be supplied and simultaneously or somewhat later is released by the conveying means 10x, guidance by the guide element 12x is no longer necessary and would in fact be undersirable in certain cases. Below the conveying flow and at this point of the conveying path is provided a processing device, so that the guide element 12 is advantageously moved upwards out of the conveying flow. It is advantageous to delay it compared with the printed products 11, so that the latter are no longer guided. Thus, over a delivery of discharge path AS the guide element 12x is moved in such a way that it is delayed compared with the printed product 11x in the conveying direction and is moved upwards so that at the discharge or delivery point A it reaches the upper edge of the printed products 11. As the real positions of the printed product 11x following the positioning point P are dependent of the specific use of the inventive method, the real positions of the printed product 10.8–10.11 (continuous lines), i.e. those printed products which have already passed through the positioning point P, are not shown in the drawing.

The spacings c between the guide elements 12 and the speed $V_F$ü of the guide elements 12 are the same on the discharge path AS as on the insertion path ES, so that for the path AS the following condition applies:

$$(a \cdot AS)/(c \cdot AS') = \cos \alpha$$

in which $tg\beta = 1/AS$ and $AS' = AS + d + q$.

The indicated conditions only apply under the simplifying assumptions that the guide elements have no extension in the conveying direction and that they are always moved linearly, i.e. their movement path at the positioning point P has a kink or bend as shown in the drawing.

From the discharge point A, the guide elements 12 are moved back to the insertion point E over a random path. The total length of the movement path of the guide elements 12 must be an integral multiple of the spacing c between the guide elements 12.

A further embodiment of the method shown in FIG. 1 comprises the distance of being equal to zero, i.e. the intended position of the suspended printed products 11 at the positioning point P being a vertical position. For an intended position with the lower edge in the conveying direction behind the upper edge of the printed products 11 d become negative, which represents a further method variation.

The inventive method is shown in FIG. 1 on a linearly horizontally moving conveying path. However, the inventive method is not limited to linear, horizontal conveying paths and can instead be used for rising, falling or curved conveying paths.

FIG. 1 shows the movement path of the guide elements 12 within the conveying flow as being formed from two linear portions. This does not constitute a condition for the inventive method. It is possible to have movement paths with more than two linear portions and also with curved portions. Curved movement paths are particularly advantageous in conjunction with conveying sections which are non-linear. At points where the guide elements 12 change their movement direction, e.g. at the positioning point P, it is advantageous for apparatus reasons to insert a curved portion of short length between two linear parts of the movement path of the guide elements 12 (cf. apparatus in FIG. 4).

Figure 2:
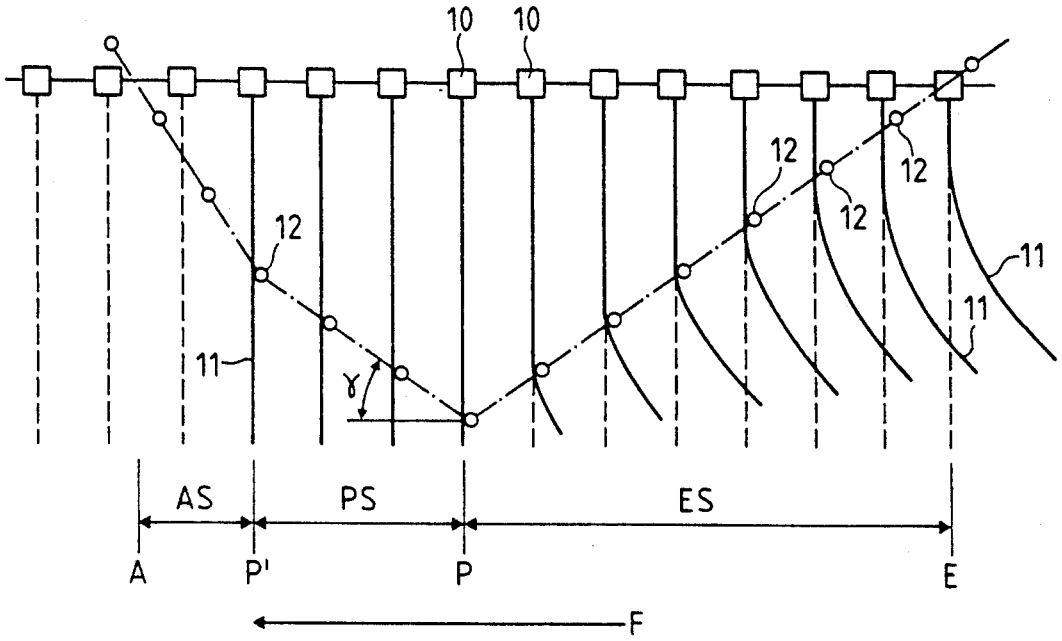
FIG. 2 is a diagram illustrating a further embodiment of the method.

FIG. 2 shows an embodiment of the method with a horizontal, linear conveying section and a movement path for the guide elements 12 formed from three linear portions. As in FIG. 1, the guide elements 12 are moved over an insertion path ES towards the intended position at the positioning point P, which in this example is on the perpendicular through the upper edge of the printed products 11 (d=0). Unlike in the embodiment described relative to FIG. 1, following the positioning point P the guide elements 12 do not immediately remain behind their associated printed products 11 and instead guide the latter over a guide portion PS in the same position which they had reached at the position point P. The angle $\gamma$ between the movement path of the guide elements 12 and the conveying direction F must be so selected for the path PS that, $$a = c \cdot \cos \gamma$$

To the guide portion PS is once again connected a discharge portion AS.

Figure 3:
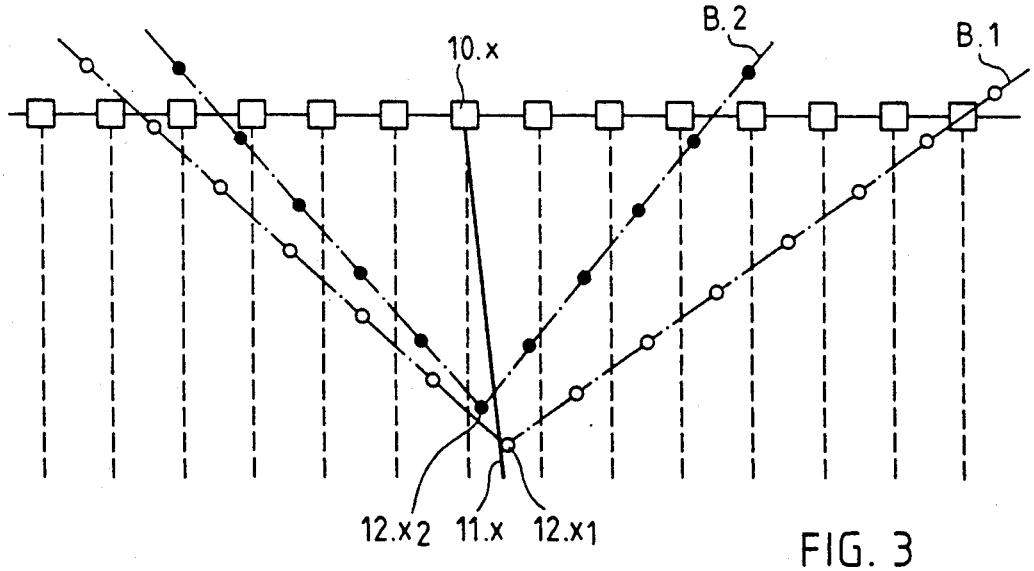
FIG. 3 is a diagram illustrating yet another embodiment of the method.

FIG. 3 shows another method embodiment which is advantageously used if the intended position of the printed products 11 at the positioning point P is roughly the same as that brought about by the air resistance, so that the latter no longer presses the products 11 to a sufficient extent against the guide elements 12 in order to guarantee a reliable guidance and stabilization. In such a case it is possible to associate with each printed product 11x two guide elements $\mathbf{12}x_1$ and $\mathbf{12}x_2$, the guide element $\mathbf{12}x_1$ (shown as a circle) moving on the movement path B1 and over the insertion distance in the conveying direction from the rear approaches the printed product 11x to be guided, whereas the guide element $\mathbf{12}x_2$ (shown as a dot) moves on the movement path B2 and approaches from the front the printed product 11x to be guided.

It is obviously also possible to conceive a method functioning solely with guide elements 12 running in the conveying direction in front of the printed products 11.

It can be advantageous for very non-or flexible rigid printed products to provide in vertically superimposed manner two guide elements for each printed product. The upper guide element prevents the air resistance from so rearwardly curving the printed product between the clips and the lower guide element that its lower edge is forced rearwards over the rear guide element. The movement paths of the lower and upper guide elements for such an arrangement are parallel to one another.

In the same way as the printed products conveyed in suspended manner, it is also possible to position and stabilize with the inventive method articles which are conveyed by lateral conveying means for those engaging on the lower edge. The guide elements are advantageously always inserted in the conveying flow from that side at which the conveying means hold the conveyed articles and are moved out of the conveying flow again on the same side.

Figure 4:
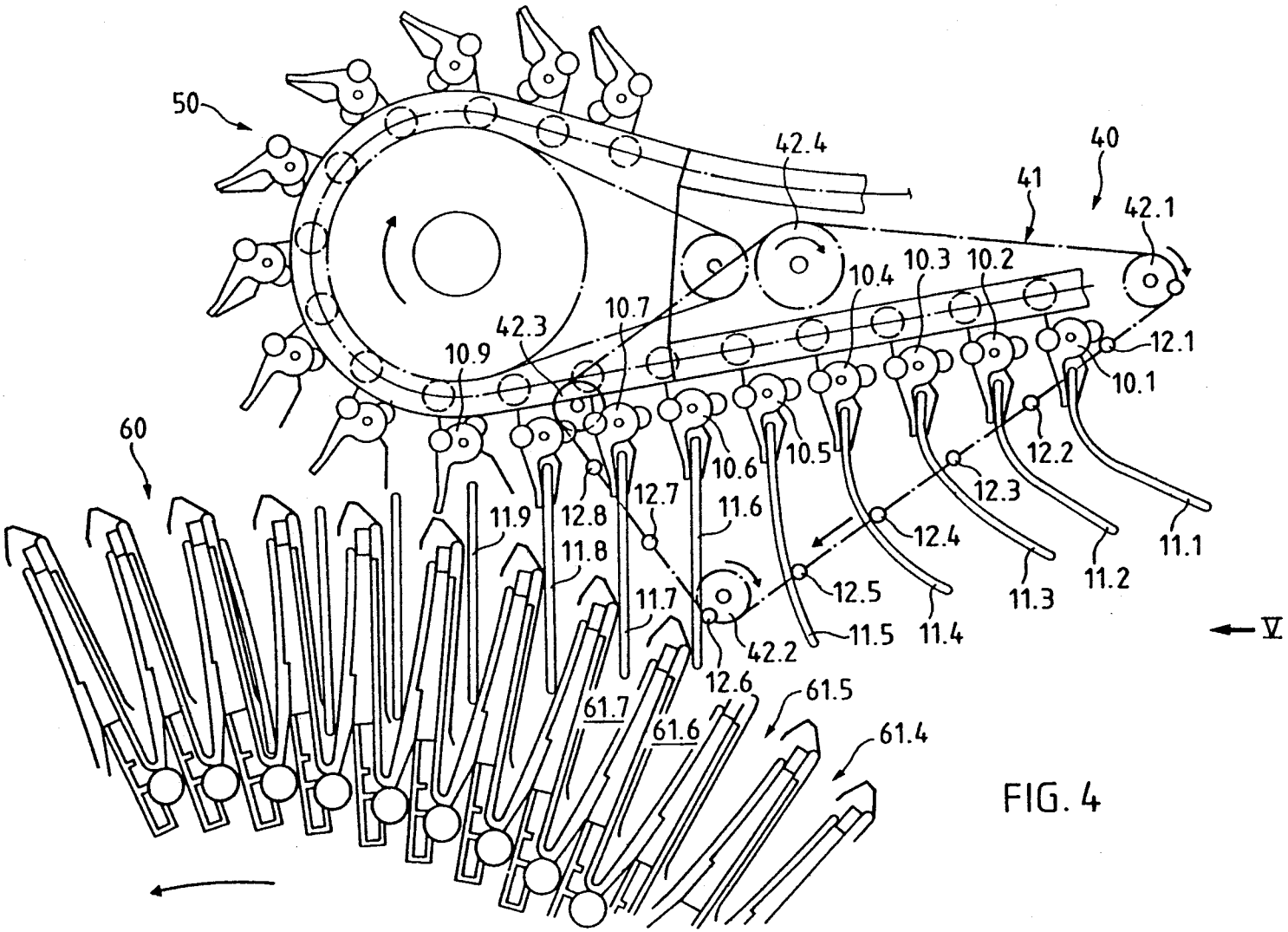
FIG. 4 is a schematic side elevation of an embodiment of the inventive apparatus for performing the method according to FIG. 1 viewed at right angles to the conveying direction.
Figure 5:
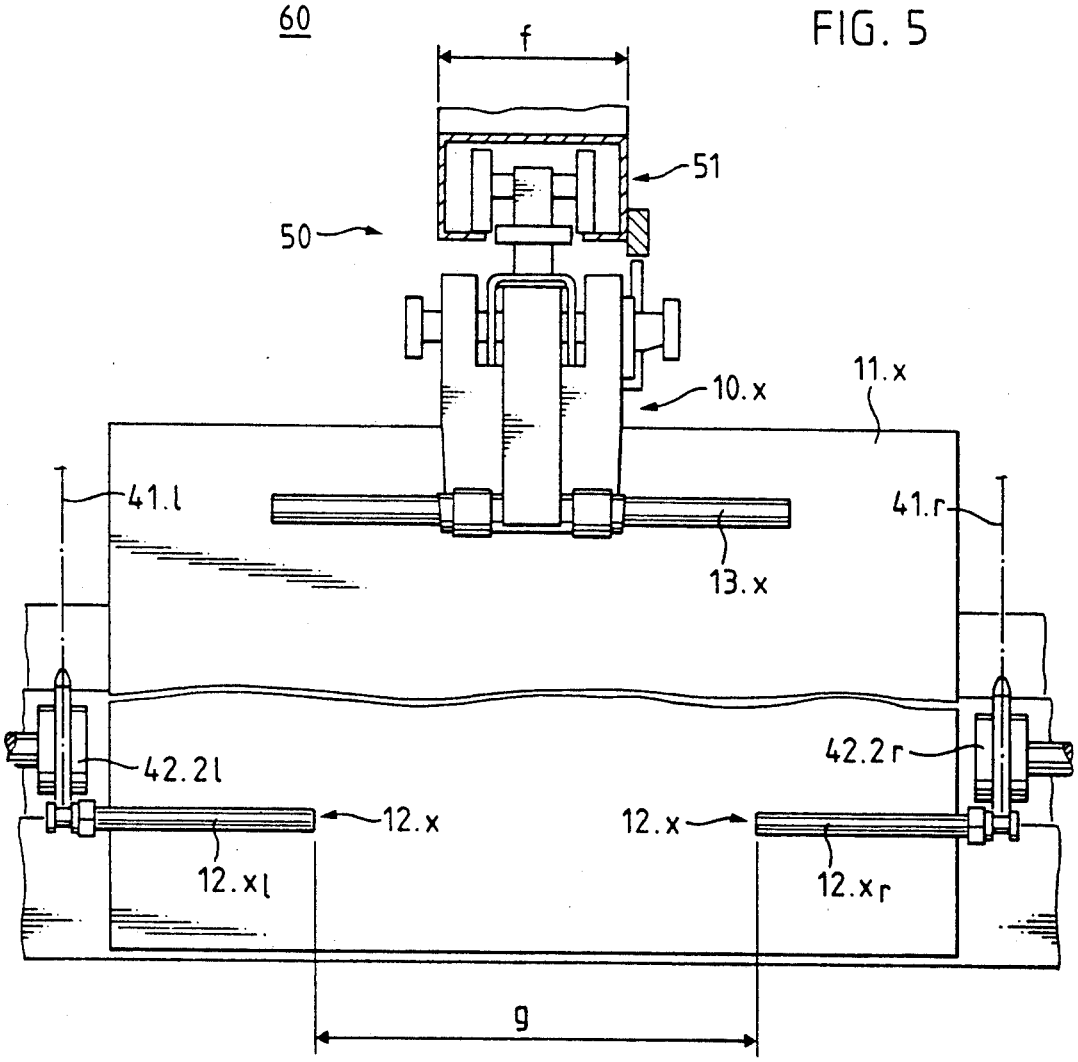
FIG. 5 is an end elevation of the same embodiment as FIG. 4, viewed parallel to the conveying direction.

FIGS. 4 and 5 show an apparatus for performing the method described in conjunction with FIG. 1. The inventive apparatus 40 is shown used together with a conveying means 50 for a conveying flow of suspended printed products and a processing drum 60. The overall arrangement is shown in FIG. 4 from a direction parallel to the axis of the processing drum 60. FIG. 5 shows as a detail a printed product 11x with the corresponding conveying clip 10x and the corresponding pairwise constructed guide element 12x considered parallel to the conveying direction. The processing drum 60 and conveying means 50 are known from the aforementioned U.S. Pat. No. 4,801,132.

FIG. 4 shows the use of the inventive apparatus. The printed products 11.1–11.3 are conveyed on clips 10.1–10.3 towards the processing drum 60 on a slightly descending conveying path. The processing drum 60 rotates in the direction of the arrow and has on its circumference compartment 61.2, 61.2, and 61.3 into which the printed product 11.1, 11.2 and 11.3 are to be inserted. The printed product 11.6 is shown in the feed or supply position and its lower edge is already located in the entrance of a corresponding compartment 61.6 of processing drum 60. In order that each printed product 11x, even at high conveying speeds, can be accurately introduced into the compartment 61x, its lower edge must be stable and in a clearly defined position when it has reached the position assumed by the printed product 11.6 in the drawing. Following the feed point, the printed product 11x is conveyed a little further by the clip 10x and the lower edge penetrates ever deeper into the corresponging compartment 61x of the processing drum 60. Only in the position in which the printed product 11.9 is shown, does the clip 10x open and the printed product 11x drops into the compartment 61x.

The positioning and stabilization of the lower edge of the printed product 11x necessary for the feed is obtained with the guide apparatus 40 with which the inventive method is performed. The guide elements 12.1–12.3 are fixed in equidistantly spaced manner on at least one tensioning means, positioned laterally from the feed or conveying flow and closed to form a loop, preferably in the form of a chain 41 (indicated as a dot-dash line) or a toothed belt. For example, the chain runs over four sprockets 42.1–42.4, whereof one is operatively connected to a drive, not visible in the drawing, so that in operation the sprockets 42.1–42.4 rotate in the directions indicated by the arrows. The chain driving speed is so matched to the printed product conveying speed that the guide elements cover the distance c in the same time as the printed products cover the distance a. The sprocket 42.2 is located at the positioning point (feed position) and brings about the direction change of the guide elements 12 required at this point. The sprockets 42.1 and 42.3 are positioned above the conveying path in the vicinity of the insertion or discharge point, while the sprocket 42.4 is located in that part of the movement path of the guide elements in which they move back from the discharge point to the insertion point. It is advantageous for space-saving reasons to drive the sprocket 42.4.

FIG. 5 shows the arrangement of a guide element 12*x* relative to a printed product 11*x*, which is conveyed by a clip 10*x*. The viewing direction is in the conveying direction and parallel to the latter, i.e. corresponding to the arrow V in FIG. 4. The clip 10*x* engages the printed product 11*x* in the center of its upper edge.

If the printed products 11 are not very rigid, it is advantageous to equip the clip 10 with stabilizing means 13. The drawing shows a stabilizing means 13*x*, which extends widthwise over the central half of the printed product. The less rigid the conveyed printed product, the wider must be the stabilization means 13*x*, so that a clearly defined position of the upper edge of the printed product in the conveying direction is ensured.

The two portions $12x_r$ and $12x_l$ of the guide element 12*x* are located on the left and right-hand sides of the printed product 11*x*. They are rod-like in this embodiment and extend over in each case roughly a quarter of the width of the printed product 11*x*. The drawing also shows in part the two chains $41_r$ and $41_l$. The chain $41_r$ carries all the right-hand parts of the guide elements 12 and the chain $41_l$ all the left-hand parts. It is also possible to see the sprockets $42.2_r$ and $42.2_l$. The represented guide element 12*x* is located in the drawing just below the sprockets 42.2, i.e. roughly at the positioning point.

In order that the two parts of the guide element 12*x* can be moved upwards out of the conveying flow, the distance g between them must be at least as large as the width f of the driven part 51 of the conveying means 50 carrying the clips 10.

The less rigid the printed product 11*x*, the longer must be the parts $12x_r$ and $12x_l$ of the guide element 12*x*. For very unrigid printed products, it can also be advantageous to construct parts $12x_r$ and $12x_l$ of the guide element 12*x* as plates instead of rods and which offer more hold or support in the vertical direction for the product 11*x*. For very rigid printed products 11, it is completely adequate to have guide elements which comprise a single part located on one side of the conveying flow.

For performing the method according to FIG. 2, it is necessary to position a further sprocket between the sprockets 42.2 and 42.3 for bringing about the direction change of the guide elements following the guide path PS.

For performing the method according to FIG. 3, it is necessary to provide a further guide apparatus roughly corresponding to the guide apparatus 40. This also applies for the method with an upper and a lower guide element for each printed product.

We claim:

1. A method for stabilizing and positioning flat articles conveyed to a predetermined location P comprising the steps of establishing a flow of articles in a direction along a path, the articles each being grasped along an edge at a plurality of locations on a conveyor, moving a plurality of guide elements in the same general direction as the flow of articles, introducing the moving guide elements into the flow of articles from the edges of the articles adjacent the grasping locations, contacting an article with each guide element so that each guide element adjusts the position of the contacted article relative to its grasping location as the articles and guide elements are moving toward the location P, and extracting the guide elements from the flow path.

2. A method according to claim 1 wherein the articles are non-rigid printed products.

3. A method according to claim 2 and including moving the guide elements at uniform speed along a closed path with uniform spacing between the guide elements, a portion of the closed path being in the flow of conveyed articles.

4. A method according to claim 3 and including contacting each article with at least one guide element.

5. A method according to claim 4 and including contacting each article with a plurality of guide elements.

6. A method according to claim 4 and including contacting each article with two guide elements, one preceding the article and the other following the article in the direction of flow.

7. A method according to claim 5 wherein the guide elements are extracted from the flow of articles on the grasped side of the articles.

8. A method according to claim 2 wherein the guide elements are extracted from the flow of articles on the grasped side of the articles.

9. A method according to claim 2 wherein each guide element is moved along an insertion path having a horizontal length ES as the guide element is introduced into the flow of articles, the insertion path entering the flow from above and in the direction of flow, the method including moving each guide element toward a desired position relative to a grasping location as the guide element and a printed product grasped at that grasping location move toward the location P so that the guide element reaches the desired position at the location P at the end of the insertion path.

10. A method according to claim 9 wherein the desired position of the guide element is one in which the printed product hangs from the grasping location and occupies a vertical orientation.

11. A method according to claim 9 wherein the desired position of the guide element is one in which the printed product occupies an orientation wherein a distal edge of the printed product is horizontally offset from the grasping location.

12. A method according to claim 9 wherein the step of extracting includes moving the guide element upwardly and out of the flow path after the printed product has reached the location P.

13. A method according to claim 12 and including removing the printed product from the conveyor at location P.

14. A method according to claim 12 and including, after the guide element has reached location P, guiding the printed product along a path PS as the guide element is extracted from the flow path.

15. An apparatus for conveying, stabilizing and positioning flat articles comprising the combination of conveyor means for conveying a plurality of flat articles along a flow path including means for engaging each of said plurality of flat articles at an edge thereof so that the articles extend from spaced locations along the conveyor means to a distal edge;

guide means including a plurality of guide elements and endless means for supporting said guide elements uniformly spaced apart and for transporting said guide elements along a closed path; and roller means for supporting said guide means so that said closed path crosses said conveyor means and extends along said flow path with said guide elements approaching and contacting said articles extending from said conveyor means to thereby position the distal edges of said articles in a desired orientation relative to said edge engaged by said conveyor means.

16. An apparatus according to claim 15 wherein said endless means includes a chain forming a loop and said roller means includes at least three sprockets rotatably mounted laterally of said flow path, said apparatus further comprising drive means connected to drive one of said sprockets.

17. An apparatus according to claim 16 wherein two of said sprockets are rotatably mounted above said flow path and one sprocket is rotatably mounted below said means for engaging said flat articles.

18. An apparatus according to claim 17 wherein said means for engaging includes a plurality of uniformly spaced clamps, said spacing between said guide elements being greater than said spacing between said clamps.

19. An apparatus according to claim 18 wherein each said guide element includes first and second guide members having their axes aligned perpendicular to the direction in which said articles are conveyed along said flow path.

20. An apparatus according to claim 15 wherein said means for engaging includes a plurality of uniformly spaced clamps, said spacing between said guide elements being greater than said spacing between said clamps.

21. An apparatus according to claim 20 and further including processing means for receiving said flat articles from said conveyor means.

22. An apparatus according to claim 21 wherein said processing means is a processing drum.

23. A method for stabilizing and positioning flat articles conveyed to a predetermined location P comprising the steps of providing a conveyor moving along a path and having a plurality of clamping locations thereon, establishing a flow of articles in a direction along the path, each article being suspended from a clamping location on the conveyor so that the article has a clamped portion and a portion hanging below the conveyor to a distal edge, moving a plurality of guide elements in the same general direction as the flow of articles, introducing the moving guide elements into the flow of articles from above the conveyor past the portions of the articles clamped to the conveyor, contacting each article with a guide element so that each guide element adjusts the position of the hanging portion of the contacted article relative to its clamped portion as the articles and guide elements are moving toward the location P, and extracting the guide elements from the flow path.

* * * * *